US009528166B2

(12) United States Patent
Ebner et al.

(10) Patent No.: US 9,528,166 B2
(45) Date of Patent: Dec. 27, 2016

(54) CLOSED TRANSPORT FLUID SYSTEM FOR FURNACE-INTERNAL HEAT EXCHANGE BETWEEN ANNEALING GASES

(71) Applicant: EBNER INDUSTRIEOFENBAU GMBH, Leonding (AT)

(72) Inventors: Robert Ebner, Leonding (AT); Heribert Lochner, Leonding (AT)

(73) Assignee: Ebner Industrieofenbau GmbH, Leonding (AT)

( * ) Notice: Subject to any disclaimer, the term of this patent is extended or adjusted under 35 U.S.C. 154(b) by 273 days.

(21) Appl. No.: 14/365,516

(22) PCT Filed: Dec. 11, 2012

(86) PCT No.: PCT/EP2012/075128
§ 371 (c)(1),
(2) Date: Jun. 13, 2014

(87) PCT Pub. No.: WO2013/087648
PCT Pub. Date: Jun. 20, 2013

(65) Prior Publication Data

US 2014/0374969 A1 Dec. 25, 2014

(30) Foreign Application Priority Data

Dec. 14, 2011 (DE) ..... 10 2011 088 634

(51) Int. Cl.
*C21D 9/00* (2006.01)
*F27B 11/00* (2006.01)
(Continued)

(52) U.S. Cl.
CPC ..... *C21D 9/0006* (2013.01); *C21D 1/34* (2013.01); *C21D 9/677* (2013.01); *F27B 11/00* (2013.01);
(Continued)

(58) Field of Classification Search
CPC ..... C21D 1/767; F27D 17/004
(Continued)

(56) References Cited

U.S. PATENT DOCUMENTS 2,479,102 A 8/1949 Dailey, Jr.
2004/0217527 A1 11/2004 Ebner et al.
(Continued)

FOREIGN PATENT DOCUMENTS

AT 411 904 B 7/2004
AT 507 423 A4 5/2010
(Continued)

OTHER PUBLICATIONS

Office action issued in Chinese parallel application No. 201280069541.9 on Jun. 26, 2015, 10 pages (no available translation).

*Primary Examiner* — Scott Kastler
(74) *Attorney, Agent, or Firm* — Lewis Roca Rothgerber Christie LLP

(57) ABSTRACT

A furnace for heat treating an annealing material. A sealable first furnace chamber is designed to receiving and heat treating annealing material. A first heat exchanger is arranged in the first furnace chamber. The first heat exchanger is arranged within a housing section of the first furnace chamber. A sealable second furnace chamber is designed for receiving and for heat treating annealing material. A second heat exchanger is arranged in the second furnace chamber. The second heat exchanger is arranged within a housing section of the second furnace chamber. A closed transport fluid path is connected to the first heat exchanger and to the second heat exchanger for transferring thermal energy between the first annealing gas and the second annealing gas.

20 Claims, 10 Drawing Sheets

(51) Int. Cl.

| | |
|---|---|
| ***F27D 17/00*** | (2006.01) |
| ***C21D 9/677*** | (2006.01) |
| ***C21D 1/34*** | (2006.01) |
| *C21D 1/26* | (2006.01) |
| *F27D 99/00* | (2010.01) |

(52) U.S. Cl.
CPC ..... *F27D 17/004* (2013.01); *C21D 1/26* (2013.01); *F27D 2099/0065* (2013.01)

(58) Field of Classification Search
USPC ..... 266/44, 155
See application file for complete search history.

(56) References Cited

U.S. PATENT DOCUMENTS

| | | | | |
|---|---|---|---|---|
| 2012/0009536 | A1 | 1/2012 | Ebner et al. | |
| 2013/0040256 | A1 | 2/2013 | Ebner et al. | |
| 2014/0333015 | A1* | 11/2014 | Ebner | C21D 9/677 266/44 |
| 2014/0374969 | A1* | 12/2014 | Ebner | F27B 11/00 266/44 |

FOREIGN PATENT DOCUMENTS

| | | | | |
|---|---|---|---|---|
| AT | 508 776 | A4 | 4/2011 | |
| CN | 101956061 | A | 1/2011 | |
| GB | 1518100 | A * | 7/1978 | C21D 1/767 |
| SU | 1740459 | A1 | 6/1992 | |

* cited by examiner

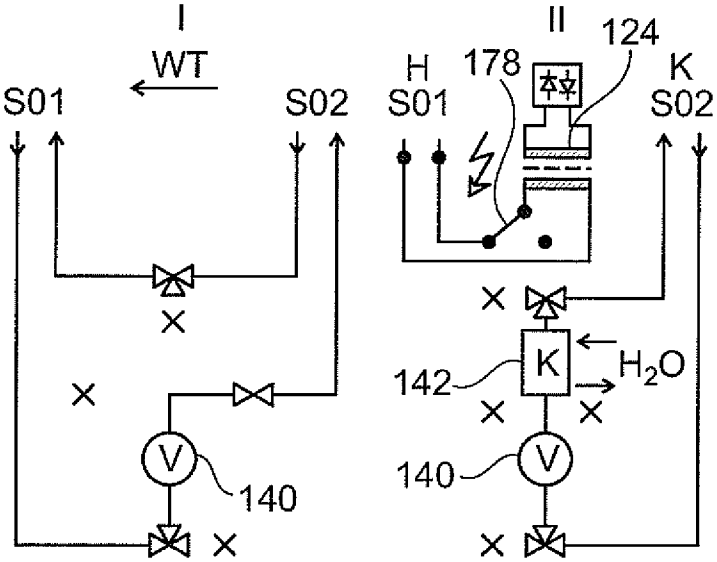
Fig. 2
Fig. 3
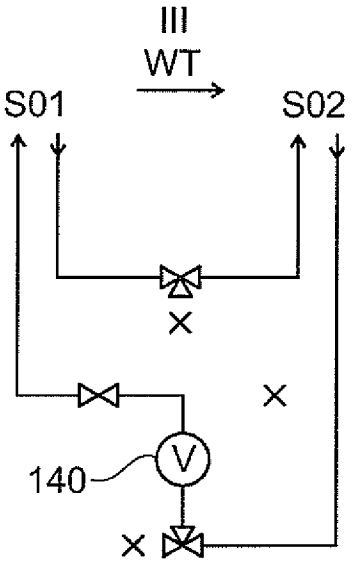
Fig. 4
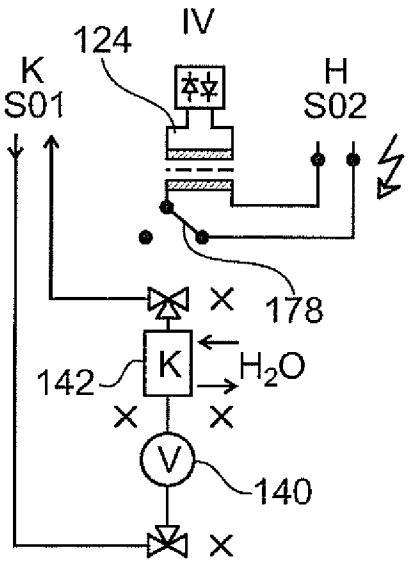
Fig. 5

CLOSED TRANSPORT FLUID SYSTEM FOR FURNACE-INTERNAL HEAT EXCHANGE BETWEEN ANNEALING GASES

This application is a National Phase Patent Application and claims priority to and benefit of International Application Number PCT/EP2012/075128, filed on Dec. 11, 2012, which claims priority to and benefit of DE Patent Application No. 10 2011 088 634.6, filed 14 Dec. 2011, the entire disclosures of which are incorporated herein by reference.

FIELD OF THE INVENTION

Embodiments of the invention relate to a furnace for heat treating of an annealing material and to a method for heat treating an annealing material in a furnace.

TECHNOLOGICAL BACKGROUND

AT 508776 discloses a method for pre-heating an annealing material in a hood-type annealing system with annealing pedestals that accommodate the annealing material under a protective hood in a transport fluid atmosphere. The annealing material to be subjected to a heat treatment in a protective hood is pre-heated with the aid of a gaseous heat transfer medium that flows around the protective hoods from the outside in a circuit, wherein said heat transfer medium absorbs heat from annealing material that has already been heat-treated in one protective hood and emits heat to annealing material to be pre-heated in another hood. At least one further annealing pedestal with a protective hood that can be heated from the outside by means of burners is used for the heat treatment of the annealing material. The hot exhaust gases from the heating unit of this protective hood are admixed to the heated heat transfer medium for pre-heating the annealing material.

AT 507423 discloses a method for pre-heating an annealing material in a hood-type annealing system with two annealing pedestals that accommodate the annealing material under a protective hood. The annealing material to be subjected to a heat treatment in a protective hood is pre-heated with the aid of a gaseous heat transfer medium that is circulated between the two protective hoods, wherein said heat transfer medium absorbs heat from the annealing material heat-treated in one protective hood and emits heat to the annealing material to be pre-heated in another protective hood. The circulated heat transfer medium flows around the two protective hoods from the outside while a transport fluid is circulated within the protective hoods.

AT 411904 discloses a hood-type annealing furnace, in particular for steel strip or wire coils, with an annealing pedestal that accommodates the annealing material and with a protective hood placed thereon in a gas-tight fashion. Furthermore, a radial fan is mounted in the annealing pedestal, which radial fan comprises an impeller as well as a guide apparatus that encloses the impeller and serves for circulating a transport fluid in the protective hood. A heat exchanger for cooling the transport fluid is at the input side connected to the pressure side of the radial fan via a flow channel and at the output side leads into an annular gap between the guide apparatus and the protective hood. A deflection device that can be axially displaced into the flow path of the radial fan at the pressure side serves for selectively connecting the flow channel leading to the heat exchanger (water-cooled annular tube bank) to the radial fan. The protective hood is mounted in a gas-tight fashion by means of an annular flange, namely pressed onto the pedestal flange. The heat exchanger (cooler) is located underneath the annular flange. The flow channel consists of an annular channel that originates at the outer circumference of the guide apparatus and is arranged concentric to the annular gap. The deflection device is realized in the form of an annular sliding baffle that encloses the guide apparatus on the outside.

Conventional batch-operated furnaces have a relatively high energy consumption.

SUMMARY OF THE INVENTION

There may be a need to operate a batch-operated furnace in an energy efficient manner.

According to an exemplary embodiment there is provided a furnace for heat treating an annealing material. The furnace comprises a sealable first furnace chamber that is designed for accommodating and heat treating annealing material by means of a thermal interaction of the annealing material with a heatable first annealing gas in the first furnace chamber. A first heat exchanger is arranged in the first furnace chamber, which first heat exchanger is designed for a heat exchange between the first annealing gas and a transport fluid. The first heat exchanger is arranged within a housing section (such as, for example, within a protective hood, in particular within an innermost protective hood) of the first furnace chamber. This housing section confines the first annealing gas within the interior of the first furnace chamber (this housing section that accommodates annealing material is in particular in direct contact with the first annealing gas and confines it relative to the surroundings in a hermetic or gas-tight fashion). Furthermore, a sealable second furnace chamber is provided, which is designed for accommodating and heat treating annealing material by means of a thermal interaction of the annealing material with a heatable second annealing gas in the second furnace chamber. A second heat exchanger is arranged in the second furnace chamber, which second heat exchanger is designed for a heat exchange between the second annealing gas and the transport fluid. The second heat exchanger is arranged within a housing section (such as, for example, within a protective hood, in particular within an innermost protective hood) of the second furnace chamber. This housing section confines the second annealing gas (together with the annealing material) in the interior of the second furnace chamber (this housing section that accommodates annealing material is in particular is in direct contact with the second annealing gas and confines it relative to the surroundings in a hermetic fashion). A closed transport fluid path is functionally connected to the first heat exchanger and the second heat exchanger in such a way that thermal energy can be transferred between the first annealing gas and the second annealing gas by means of the transport fluid.

According to another exemplary embodiment, there is provided a method for heat treating an annealing material in a furnace, wherein in this method annealing material is accommodated in a sealable first furnace chamber and heat treated by means of a thermal interaction of the annealing material with heatable first annealing gas in the first furnace chamber. Furthermore, a heat exchange between the first annealing gas and a transport fluid is realized by means of a first heat exchanger which is arranged in the first furnace chamber. The first heat exchanger is arranged within a housing section of the first furnace chamber. This housing section confines the first annealing gas in the interior of the first furnace chamber. Annealing material is accommodated in a sealable second furnace chamber and is heat treated by means of a thermal interaction of the annealing material with heatable second annealing gas in the second furnace chamber. In addition, a heat exchange between the second annealing gas and the transport fluid is realized by means of a second heat exchanger which is arranged in the second furnace chamber, wherein the second heat exchanger is arranged within a housing section of the second furnace chamber. This housing section confines the second annealing gas in the interior of the second furnace chamber. A closed transport fluid path which is functionally connected to the first heat exchanger and to the second heat exchanger is controlled in such a manner that thermal energy is transferred between the first annealing gas and the second annealing gas by means of the transport fluid.

According to an exemplary embodiment, a fluidic path, which is also referred to as a closed transport fluid path, may be provided separately of the annealing gas in different pedestals or furnace chambers of a furnace and functionally connected to respective heat exchangers (that are provided separately of protective hoods, in particular in the interior thereof) in the furnace chambers in order to exchange thermal energy between two separate annealing gases in the two furnace chambers. In this case, it is important to prevent a direct mechanical contact between the transport fluid and the annealing gas in the furnace chambers. Only a heat exchange between these gases or fluids by means of the respective heat exchanger is possible. In a furnace with several furnace chambers or pedestals, for example, the thermal energy of the furnace chamber that is currently in a cooling phase can in this way be used for pre-heating another furnace chamber that is currently in a heating phase. According to an embodiment, for this purpose a separate and closed transport fluid path is provided, which is fluidically connected to the heat exchangers that are arranged within the furnace chambers (which heat exchangers are therefore in particular flown around by the respective annealing gas to the full extent, i.e. in the form of a full flow). This results in an efficient utilization of the expended energy. In this case, the annealing gas of one pedestal (for example 100% hydrogen) does not come in contact with the annealing gas of the heat-exchanging partner pedestal (for example also 100% hydrogen). Consequently, an undesirable loss of quality due to sooting (caused by evaporating rolling oils or drawing agents) or an undesirable supply of traces of oxygen ($O_2$) and water ($H_2O$) while heating up the heat exchanger is also reliably prevented. Furthermore, the safety of the inventive furnace is a very high because the interaction between annealing gases of different furnace chambers or between annealing gas on the one hand and transport fluid (for example 100% hydrogen or 100% helium) on the other hand is prevented despite the fact that heat exchangers are provided.

Since the transport fluid path is decoupled from the annealing gas in the two furnace chambers fluidically, but not thermally, it is also possible to specially adapt the transport fluid used to the requirements of an efficient heat transfer, in particular to use a transport fluid with high thermal conductivity. For example, 100% H2, 100% He or other gases with a high thermal conductivity may be used. In such a fluidic decoupling of annealing gas and transport fluid, it is furthermore possible to realize the transport fluid path in the form of a high-pressure path such that the heat transfer in the highly pressurized transport fluid can be significantly increased and at the same time a particularly large quantity of heat can be transported without thereby undesirably impairing the relatively low compressed gas conditions in the individual furnace chambers.

In addition to the exchange of thermal energy that is stored in the annealing gas of the individual furnace chambers, the transport path can also be used for making available heating or cooling energy for selectively heating or cooling one of the respective furnace chambers. With respect to the transport fluid path, is decisive that it functions directly in the form of a full flow. Consequently, the transport fluid path according to the inventive embodiment can be used for a heat exchange between different furnace chambers, as well as for heating or cooling purposes.

The arrangement can be realized in a very compact fashion if only one thermally insulated protective hood is placed on the respective pedestal (without the imperative of providing additional heating or cooling hoods) in accordance with an exemplary embodiment. This advantage is achieved by positioning the heat exchangers that represent the sole heat supply units for the respective annealing gas in the interior of the annealing chamber (i.e. under the protective hood). If heating or cooling hoods are eliminated, the effort associated with the required crane operations for handling the individual hoods is also significantly reduced. A crane is essentially only required for transporting annealing material batches, as well as for transporting the protective hoods to the furnace chambers, but no longer for maneuvering cooling or heating hoods.

Other exemplary embodiments of the furnace are described below. These embodiments also apply to the method.

According to one exemplary embodiment, the furnace may be realized in the form of a batch-operable furnace, in particular in the form of a hood-type annealing furnace or a batch furnace. The term batch-operated furnace refers to a furnace, into which a batch of annealing material, for example strips to be heat-treated, is introduced. The corresponding furnace chamber is then closed and the introduced batch of annealing material is subjected to the heat treatment. In other words, a batch-operated furnace is a discontinuously operable furnace.

According to an exemplary embodiment, the first furnace chamber may be sealed with a removable first protective hood (in the form of the aforementioned housing section of the first furnace chamber) and the second furnace chamber may be sealed with a removable second protective hood (in the form of the aforementioned housing section of the second furnace chamber). The respective thermally insulated protective hood for the furnace chamber may be realized in such a way that it seals the interior of the furnace chamber in a hermetic or gas-tight fashion and an annealing gas introduced into the respective furnace chamber is reliably protected from escaping from the respective furnace chamber.

According to an exemplary embodiment, the first protective hood may be the outermost hood, in particular the only hood, of the first furnace chamber. The second protective hood likewise may be the outermost hood, in particular the only hood, of the second furnace chamber. According to this preferred embodiment, the furnace may be equipped with a single hood per furnace chamber. In comparison with conventional hood-type annealing furnaces, in which a protective hood and an additional outer heating or cooling hood are respectively placed on a pedestal, the inventive construction of the furnace with a single protective hood per pedestal is significantly simplified. This simplified construction results from positioning the respective heat exchanger in the furnace chamber and fluidically connecting the heat exchanger to the transport fluid path because this heat exchanger is capable of realizing the entire thermal coupling between the annealing gas and the transport fluid and therefore can perform all heating and cooling tasks.

Exemplary embodiments therefore can be realized with the smallest space requirement because no heating hood, no cooling hood and no interchangeable hood is required and a single thermally insulated protective hood per pedestal can suffice.

According to an exemplary embodiment, the first protective hood and the second protective hood may respectively comprise a heat-resistant inner housing, particularly of a metal, and an insulating cover of a thermally insulating material. Since the energy is in this exemplary embodiment no longer supplied via the protective hood (for example by burners of the heating hood from the outside), the wall temperature of the protective hoods drops, the heat-resistant material is not stressed as severely and the heat losses of the wall are reduced. According to this embodiment, the protective hood for hood-type annealing furnaces can have a significantly different design than conventional protective hoods. While conventional protective hoods should consist of a material with a good thermal conductivity throughout in order to realize a thermal balance between the annealing gas under the respective protective hood and another gas between the two hoods, the described exemplary embodiment takes into account the fact that a thermal interaction through the protective hood is no longer required and also no longer desired. This is the reason why the protective hood may at least partially consist of a thermally insulating material in order to suppress heat losses toward the outside.

If the furnace is realized in the form of a batch furnace, the protective hood and/or the additional protective hood may in contrast respectively comprise an outer housing, in particular of a metal, that is not necessarily heat-resistant and an inner insulating cover of a thermally insulating material.

According to an exemplary embodiment, the transport fluid path may comprise a heating unit for generating thermal heat. The heating unit may be designed for directly heating the transport fluid or the first heat exchanger or the second heat exchanger. The first furnace chamber may be heated by thermally transferring the generated thermal heat to the first annealing gas. Alternatively or additionally, the second furnace chamber may be heated by thermally transferring the generated thermal heat to the second annealing gas. The heating unit may be arranged outside of the furnace chambers, i.e. outside of the heated region. If the transport fluid path is coupled to a separate heating unit, the transport fluid itself not only can serve for the heat exchange between the annealing gas in the different furnace chambers, but also for the transport of thermal energy from the heating unit into the interior of the respective furnace chamber.

In another embodiment, with an electric supply unit (comprising, for example, a transformer) the tube bank itself can be used as a transmission medium for electrical power or can be jointly used together with other components as a transmission medium for electrical power, which transmission medium (preferably at a low voltage and a high amperage) can be converted into thermal energy in the respective heat exchanger due to ohmic losses (in accordance with the principle of an electric resistance heater). For example, a low-resistance tube wall of the transport fluid path may be used as a corresponding coupling element, to which the respective heat exchanger (in particular a tube bank) is connected. If the coupling element extends through the floor or a furnace base of the furnace chamber, the protective hood can be realized in a simple and uninterrupted manner because no supply line to the heat exchanger needs to extend through the protective hood.

When a gas heating unit is used, however, it may be preferable to heat the transport fluid itself and to convey the transport fluid along the transport fluid path by means of fans in order to realize the thermal interaction with the annealing gas in the interior of the respective furnace chamber by means of the respective heat exchanger.

This heating unit, which is arranged externally of the annealing chamber, may consist, for example, of a gas heating unit, an oil heating unit, a pellet heating unit or even an electric heating unit. The heating, e.g. with gas, may be realized by means of a heat exchanger that is arranged externally of the annealing chamber and the tube bank of which heats the hot compressed gas that can be transported to the respective annealing gas chamber heat exchanger with a fan, for example, by utilizing natural gas burners. Heating with electric energy may also be realized directly with the tube bank of the heat exchanger arranged externally of the annealing chamber by means of a transformer in order to transmit electric energy to the hot compressed gas and to transfer the thermal energy contained therein to the respective annealing gas chamber heat exchanger.

The furnace can furthermore be operated in an environmentally safe fashion, for example, because no carbon dioxide and no nitrogen oxides are produced by an (internal or external) electric heating unit. In a gas heating unit, the methane consumption for the described and highly effective heat exchange is comparatively low such that only small quantities of $CO_2$ and NO are produced. An oil heating unit can burn oil in order to generate thermal energy. A pellet heating unit can burn wood pellets in order to generate thermal energy. According to an embodiment, it is naturally also possible to use other types of thermal energy generating units.

According to an exemplary embodiment, the first furnace chamber may be sealable with a removable first heating hood that encloses the first protective hood. The second furnace chamber may be sealable with a removable second heating hood that encloses the second protective hood. According to an exemplary embodiment, the first furnace chamber may comprise a first heating unit for heating the intermediate space between the first heating hood and the first protective hood. Accordingly, the second furnace chamber may comprise a second heating unit for heating the intermediate space between the second heating hood and the second protective hood. According to this embodiment, another heating hood is provided per pedestal or furnace chamber in addition to the protective hood. This heating hood serves for heating the intermediate space between the heating hood and the protective hood, wherein a thermal balance through the protective hood then causes the annealing gas to be heated. In this embodiment, the transport fluid path may be provided for exchanging thermal energy between the annealing gases only. It is also possible to place a cooling hood on the respective furnace chamber in order to thusly initiate cooling of the annealing gas.

According to this exemplary embodiment, the first heating unit and the second heating unit may respectively be a gas heating unit. Such a gas heating unit may be a gas burner that heats the intermediate space between the heating hood and the protective hood.

According to an exemplary embodiment, the first heat exchanger and/or the second heat exchanger may be designed in the form of a tube bank heat exchanger consisting of tubes that are bent into a bank. In this context, the term tube bank heat exchanger refers to a heat exchanger that is formed by a bank of tubes that, for example, are wound circularly. The tube interior may form part of the transport fluid path, through which the transport fluid flows. The tube exterior may be brought in direct contact with the respective annealing gas. A tube bank heat exchanger may be composed, in particular, of tubes that are arranged such that they extend parallel to one another. The tube wall may be realized in a gas-tight and heat-resistant fashion. The arrangement may be configured in such a way that the transport fluid is pushed or conveyed through the interior of the tubes and separated from the respective annealing gas by the tube wall. The tube bank can make available a large effective heat exchange surface such that the transport gas and the respective annealing gas can exchange large amounts of thermal energy. Exemplary embodiments can furthermore be used in a fully automatic mode.

According to an embodiment, a heat exchanger in the form of a tube bank that can be placed into the full flow may be utilized in the individual furnace chambers. This serves for exchanging heat between a batch of annealing material to be cooled and a batch of annealing material to be pre-heated. Furthermore, tube bank heat exchangers make it possible to heat the annealing material to the respective annealing temperature. The same tube bank heat exchanger can also be used for cooling the annealing material to a final temperature (for example a removal temperature of the annealing material).

According to an exemplary embodiment, the first furnace chamber may comprise a first annealing gas fan and the second furnace chamber may comprise a second annealing gas fan, wherein the respective annealing gas fan is designed for directing the respective annealing gas at the respective heat exchanger and at the respective annealing material. A respective annealing gas fan may be arranged in a lower region of the respective pedestal or furnace chamber and circulate the annealing gas in order to realize a good thermal interaction with the annealing material in the respective furnace chamber. For this purpose, the respective annealing gas fan can deflect the annealing gas in a certain direction by means of a guide apparatus.

According to an exemplary embodiment, the transport fluid may be a transport gas with a good thermal conductivity, in particular hydrogen or helium. The transport fluid may generally be a liquid or a gas. When hydrogen or helium is used, it is possible to utilize their superior thermal conductivity. In addition, these gases can also be advantageously utilized under high pressure.

According to an exemplary embodiment, the transport fluid in the transport fluid path may be subjected to a pressure between approximately 2 bar and approximately 20 bar or more, in particular to a pressure between approximately 5 bar and approximately 10 bar. Consequently, a significant overpressure of the transport fluid relative to the atmospheric pressure can be generated, wherein this overpressure can exceed the only slight overpressure, to which annealing gas may be subjected in the furnace. Since high pressure is used in the heat exchanger, it is possible to design the heat exchanger in an in particular efficient fashion without requiring high-pressure capability in the first and the second furnace chamber.

According to an exemplary embodiment, the transport fluid in the transport fluid path can be heated to a temperature in the range between approximately 400° C. and approximately 1100° C., in particular in the range between approximately 600° C. and approximately 900° C. For example, the transport fluid in the transport fluid path may be heated to a temperature in the range between 700° C. and 800° C. Consequently, the temperatures required for the treatment of annealing material such as, for example, strips or wires or profiles of steel, aluminum or copper and/or their alloys can be generated in the furnace chambers by means of the transport fluid.

According to an exemplary embodiment, the furnace may furthermore comprise a sealable third furnace chamber that is designed for accommodating and heat-treating annealing material by means of a thermal interaction of the annealing material with a heatable third annealing gas in the third furnace chamber, as well as a third heat exchanger that is arranged in the third furnace chamber and that is designed for a heat exchange between the third annealing gas and the transport fluid. The third heat exchanger may also be arranged within a housing section of the third furnace chamber that confines the third annealing gas in the interior of the third furnace chamber. The closed transport fluid path may also be functionally connected to the third heat exchanger in such a way that thermal energy can be transferred between the first annealing gas and the second annealing gas and the third annealing gas by means of the transport fluid. According to this embodiment, at least three furnace chambers can be coupled to one another. In this case, one can distinguish between an energy-exchanging pre-heating cycle, a heating cycle and a cooling cycle in each one of the individual furnace chambers. Two of the three furnace chambers can be thermally coupled by means of the transport fluid in a cyclic fashion, for example, in order to pre-cool one furnace and pre-heat another furnace. The respective third furnace can then be subjected to a heating procedure or to a cooling procedure. The heat exchange between the furnace chambers can take place in one stage when using two furnace chambers, in two stages when using three furnace chambers or in multiple stages when using more than three furnace chambers.

According to an exemplary embodiment, the furnace may comprise a control unit that is designed for controlling the transport fluid path in such a way that the first furnace chamber or the second furnace chamber can be selectively operated in a pre-heating mode, a heating mode, a pre-cooling mode or a final cooling mode due to a heat exchange between the transport fluid and the first annealing gas and the second annealing gas. Such a control unit may be, for example, a microprocessor that coordinates the operating mode of the different furnace chambers. In this case, the control unit may respectively control, for example, the heating unit, the cooling unit and valves of the fluidic system in order to automatically execute an operating sequence. The term pre-heating mode may refer to an operating mode of the furnace chamber, in which an annealing gas is heated to an elevated intermediate temperature due to a transfer of thermal energy from another annealing gas. An annealing gas can be subjected to one or several successive pre-heating phases. In a heating mode, an annealing gas that was pre-heated in one or more stages in the above-described manner can then be heated by means of an additional heating unit (gas, electric, etc.) that is arranged externally of the furnace chamber in order to heat the annealing gas to a high final temperature. After the completion of the heating mode and prior to the beginning of the cooling mode, an annealing gas may be subjected to a pre-cooling procedure (a quasi-inverse process of the above-described pre-heating procedure), in which the annealing gas is cooled to a lower intermediate temperature by indirectly transferring thermal energy to the annealing gas from another annealing gas in a detoured fashion via the transport fluid gas. In a final cooling mode, the fluid gas and therefore the annealing gas can be cooled by means of a cooling unit (for example a water-cooling unit) that is arranged externally of the furnace in order to cool the annealing gas to a lower temperature.

According to an exemplary embodiment, the transport fluid path may comprise a transport fluid fan for conveying the transport fluid through the transport fluid path. The transport fluid fan therefore can convey the transport fluid along specific paths that can be predefined by corresponding valve settings.

According to an exemplary embodiment, the transport fluid path may comprise a connectable cooler for cooling the transport fluid in the transport fluid path. Such a connectable cooler (that is based, for example, on the water-cooling principle of a tube bank) makes it possible to act upon the transport fluid with cooling energy that can be coupled into the individual furnace chambers by means of the respective heat exchanger.

According to an exemplary embodiment, the transport fluid path may comprise a plurality of valves. The valves may be, for example, pneumatic valves or solenoid valves that can be switched by means of electrical signals. Different operating modes can be adjusted if the valves are suitably arranged in the fluidic path. The valves can be switched (for example by a control unit) in such a way that the furnace can be selectively operated in one of the following operating modes:

a) a first operating mode, in which the transport fluid fan thermally couples the transport fluid with the second annealing gas such that the transport fluid absorbs heat from the second annealing gas and transfers heat to the first annealing gas in order to pre-heat the first furnace chamber and pre-cool the second furnace chamber;

b) a subsequent second operating mode, in which a heating unit additionally heats the first furnace chamber and in which the transport fluid fan feeds the transport fluid to be cooled to the connected cooler along a separate path and thermally couples the cooled transport fluid with the second annealing gas in order to additionally cool the second furnace chamber;

c) a subsequent third operating mode, in which the transport fluid fan thermally couples the transport fluid with the first annealing gas such that the transport fluid absorbs heat from the first annealing gas and transfers heat to the second annealing gas in order to pre-heat the second furnace chamber and pre-cool the first furnace chamber;

d) a subsequent fourth operating mode, in which the heating unit additionally heats the second furnace chamber and in which the transport fluid fan feeds the transport fluid to be cooled to the connected cooler along a separate path and thermally couples the cooled transport fluid with the first annealing gas in order to additionally cool the first furnace chamber.

These four operating modes can be successively repeated such that a cyclic process is carried out.

According to an exemplary embodiment, the heat exchanger in the furnace may be realized in a pressure-resistant manner or may comprise a pressure vessel that encloses at least a part of the transport fluid path in a pressure-tight fashion. For example, the entire transport fluid path, which can be operated under high pressure, e.g. 10 bar, may be realized with pressure-resistant tubes, valves and transport fluid fans or may be accommodated in a pressure vessel or another pressure protection device. However, it is also possible to encase components that are subjected to significant pressure, in particular the transport fluid fan, with a pressure vessel.

According to an exemplary embodiment, the first heat exchanger may be arranged relative to a first annealing gas fan for conveying the first annealing gas and/or the second heat exchanger may be arranged relative to a second annealing gas fan for conveying the second annealing gas in such a way that the first annealing gas conveyed by the first annealing gas fan flows against the first heat exchanger in each operating mode of the furnace and/or that the second annealing gas conveyed by the second annealing gas fan flows against the second heat exchanger in each operating mode of the furnace or a respective furnace chamber.

A significant advantage of such an embodiment can be seen in that the annealing gas conveyed by the fan is directly directed at the respective heat exchanger in each operating mode (in particular for heating by means of a heating device, for cooling by means of a cooling device and for exchanging heat between the annealing gas and the heat exchanger). Such a direct flow of the annealing gas conveyed by the fan to the heat exchanger may be realized, in particular, in the form of a full flow, i.e. to the full extent along a circumference (for example an imaginary circle) around the fan. In this way, a very efficient thermal coupling between the annealing gas and the respective heat exchanger can be achieved. The respective heat exchanger may be mounted at the furnace, in particular, in a stationary or immovable fashion in order to ensure that annealing gas conveyed by the fan is directed at an approximately circular tube bank heat exchanger or a different heat exchanger by means of directional baffles or the like. In order to ensure that the respective annealing gas conveyed by the respective annealing gas fan flows against the respective heat exchanger in each operating mode of the furnace or a respective furnace chamber, the respective heat exchanger should be stationarily and immovably arranged and permanently fixed at a corresponding location of the furnace. A heating mode for heating by means of a heating unit, a cooling mode for cooling by means of a cooling unit and a heat exchanging mode for exchanging heat between different furnace chambers by utilizing the transport fluid path (for pre-heating or pre-cooling purposes) may be considered as the potential operating modes of the furnace or a respective furnace chamber.

According to an exemplary embodiment, the first annealing gas and the second annealing gas may not come in contact with the transport fluid in the furnace. Consequently, it can be constructively ensured that the annealing gas does not come in contact with the transport fluid gas such that no sooting occurs.

Exemplary embodiments of the present invention are described in greater detail below with reference to the following figures.

DESCRIPTION OF THE DRAWING

FIGS. 2 to 5 show schematic representations of different operating states during a cyclic process for operating the hood-type annealing furnace according to FIG. 1.

Identical or similar components are identified by the same reference numerals in the different figures.

DETAILED DESCRIPTION OF EXEMPLARY EMBODIMENTS

Figure 1:
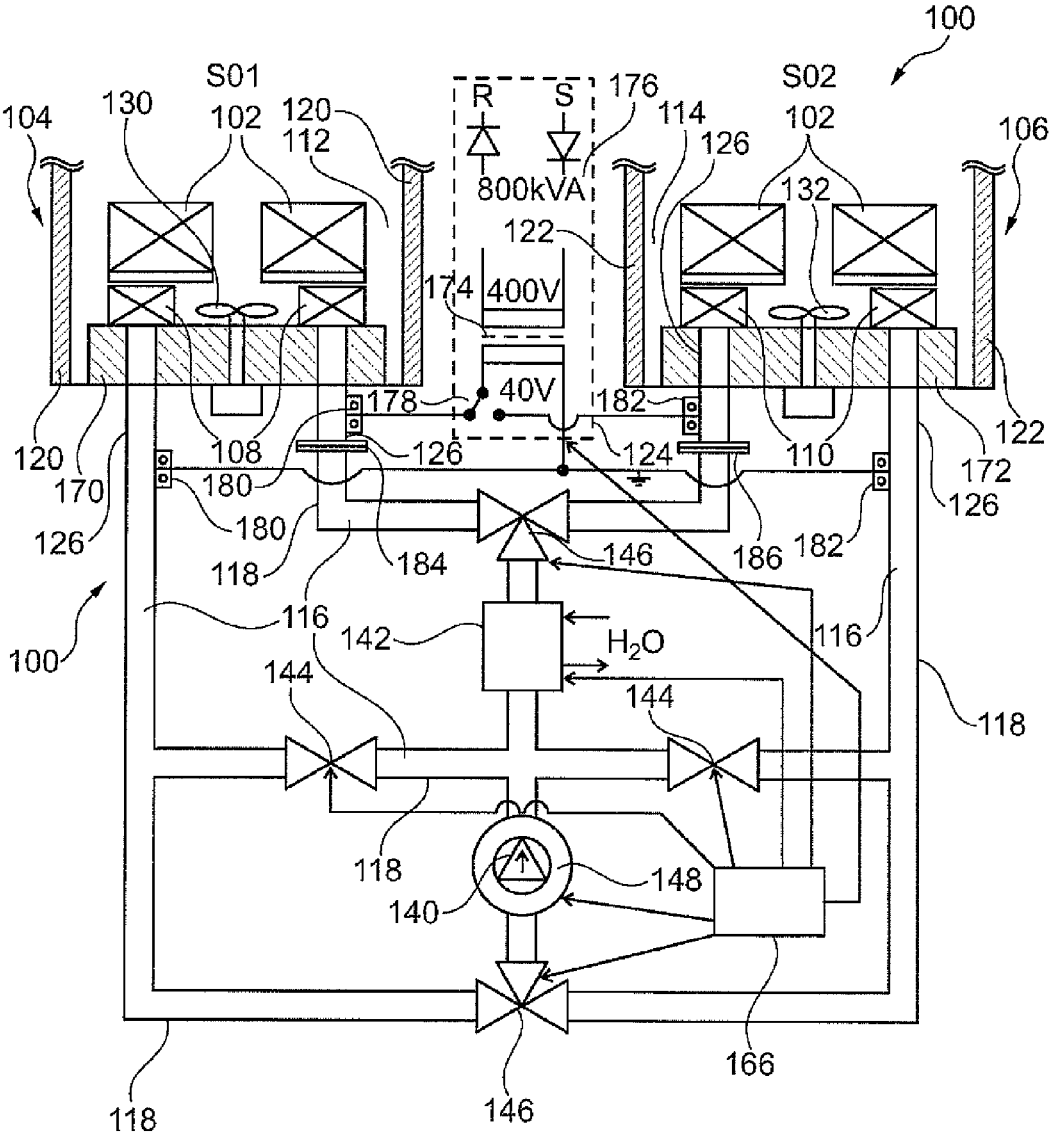
FIG. 1 shows a hood-type annealing furnace for heat treating an annealing material with a plurality of pedestals according to an exemplary embodiment, wherein an annealing gas can be heated or cooled in said furnace by means of a heat exchanger. The heating of the heat exchanger is accomplished initially by means of a transport gas from another heat exchanger (a cooling pedestal) and subsequently by means of an electric supply unit. The cooling of the heat exchanger is accomplished initially by means of transport gas from another heat exchanger (a heating pedestal) and subsequently by means of a connectable cooling device.

A hood-type annealing furnace 10 according to an exemplary embodiment is described below with reference to FIG. 1.

The hood-type annealing furnace 100 is designed for heat treating an annealing material 102. This annealing material is partially arranged on a first pedestal So1 of the hood-type annealing furnace 100 and partially arranged on a second pedestal So2 of the hood-type annealing furnace 100. The annealing material 102 that only is schematically illustrated in FIG. 1 may consist, for example, of steel strip or wire coils or similar materials (e.g. bulk material arranged in tiers) that should be subjected to a heat treatment.

The hood-type annealing furnace 100 has a first sealable furnace chamber 104 that is assigned to the first pedestal So1. The first furnace chamber 104 serves for accommodating and heat-treating annealing material 102 that is fed to the first pedestal So1 in batches. The first furnace chamber 104 is sealed in a gas-tight fashion with a first protective hood 120 in order to carry out the heat treatment. The first protective hood 120 is realized similar to a bell and can be maneuvered by means of a (not-shown) crane.

A first annealing gas 112 such as, for example, hydrogen can then be introduced into the first furnace chamber 104 that is hermetically sealed by means of the first protective hood 120 and heated as described in greater detail below. A first annealing gas fan 130 (or pedestal fan) in the first furnace chamber 104 can be rotatively driven in order to circulate the annealing gas 112 in the first furnace chamber 104. In this way, the heated first annealing gas 112 can be brought in effective thermal contact with the annealing material 102 to be heat-treated.

A first tube bank heat exchanger 108 is arranged in the first furnace chamber 104. This heat exchanger is formed of several tube windings, wherein a transport gas 116 described in greater detail below is fed to a tube inlet, conveyed through the interior of the tube and discharged through a tube outlet. An outer surface of the tube bank is in direct contact with the first annealing gas 112. The first tube bank heat exchanger 108 serves for the thermal interaction between the first annealing gas 112 and the transport gas 116 that, according to an exemplary embodiment, is a gas with a good thermal conductivity, for example hydrogen or helium, under high pressure, for example 10 bar. In a descriptive sense, the first tube bank heat exchanger 108 can be seen as a plurality of wound-up tubes, wherein the transport gas can be conveyed through the interior of the tubes and can be brought in a thermal interaction with the first annealing gas 112 being circulated around the outer wall of the tubes by means of the, for example metallic, wall of the tubes that has a good thermal conductivity. In other words, the first annealing gas 112 and the transport gas 116 are indeed fluidically decoupled and separated from one another in an unmixable manner, but a thermal interaction can take place in the form of a full flow by means of the first tube bank heat exchanger 108.

The first tube bank heat exchanger 108 is arranged relative to the first annealing gas fan 130 for conveying the annealing gas in such a way that the annealing gas conveyed by the first annealing gas fan 130 flows against the first tube bank heat exchanger 108 in each operating state of the furnace 100. The basic mechanism is described in greater detail with reference to FIG. 16.

If high pressure, for example 10 bar, is used for conveying the transport gas 116, the tubes of the transport gas path 118 can be realized with small dimensions such that a compact construction is achieved. The pressure of the transport gas 116 can be chosen much higher than the pressure of the annealing gas 112 and the annealing gas 114 in the respective furnace chambers 104, 106 (for example a slight overpressure between 20 mbar and 50 mbar above atmospheric pressure).

The second pedestal So2 is realized identically to the first pedestal So1. It contains a second annealing gas fan 132 for circulating a second annealing gas 114, for example also hydrogen, in a second furnace chamber 106. The second furnace chamber 106 can be hermetically sealed relative to the surroundings by means of a second protective hood 122.

A second tube bank heat exchanger 110 allows a thermal yet contactless interaction between the second annealing gas 114 and the transport gas 116.

Two pedestals So1, So2 are illustrated in the exemplary embodiment according to FIG. 1, but two or more pedestals may also be functionally coupled to one another in other exemplary embodiments.

The bottom of the first furnace chamber 104 is defined by a first furnace base 170 (i.e. a heat-insulated lower pedestal part) whereas the bottom of the second furnace chamber 106 is defined by a second furnace base 172. In order to allow a fluidic interaction between the transport gas 116 being circulated in the transport gas tube system and the first annealing gas 112, the transport gas 116 can be fed to the tube interior of the first tube bank heat exchanger 108 through the first furnace base 170. The transport gas 116 can be similarly fed to the tube interior of the second tube bank heat exchanger 110 through the second furnace base 172. Since the transport gas 116 is introduced into and removed from the respective furnace chamber 104, 106 on the bottom side through the respective furnace base 170, 172, the energy supply into the respective pedestal So1 or So2 and the energy removal from the respective pedestal So1 or So2 also take place through the furnace bases 170, 172.

The transport gas 116 is circulated through a closed transport gas path 118 that can also be referred to as a closed transport circuit. In this context, the term closed means that the transport gas 116 is confined in the heat-resistant and pressure-resistant transport gas path 118 in a gas-tight fashion and prevented from leaking out of the system and from mixing with other gases, as well as from pressure compensation with the surroundings. The transport gas 116 therefore circulates through the transport gas path 118 for many cycles before the transport gas 116 can be exchanged, for example, by being removed with the aid of a pump or the like. A contacting interaction or mixing of the transport fluid gas 116 with the annealing gas 112 or 114 is prevented due to the purely thermal coupling realized by means of the tube bank heat exchangers 108, 110.

The first tube bank heat exchanger 108 functionally serves as a heat emitting device or heat absorbing device that—aside from input lines and output lines—is arranged entirely in the interior of the first furnace chamber 104 sealed by the first protective hood 120. The second tube bank heat exchanger 110 also functionally serves as a heat emitting device or heat absorbing device that—aside from input lines and output lines—is arranged entirely in the interior of the second furnace chamber 106 sealed by the second protective hood 122. Consequently, the heat transfer to the respective annealing gas 112, 114 in the hood-type annealing furnace 100 is realized by means of a heat emitting device or heat absorbing device in the form of the respective tube bank heat exchangers 108, 110 that are arranged in the interior of the respective furnace chambers 104, 106 (and provided separately or independently of the protective hoods 120, 122 and covered thereby). Due to this heat transfer to the annealing gas 112, 114 within the protective hoods 120, 122 only, it is not necessary, according to an embodiment of the invention, to provide additional hoods outside the protective hoods 120, 122. In other words, the entire thermal interaction between the annealing gas 112, 114 and the heat source is in accordance with an embodiment of the invention realized within the sole protective hood 120, 122 of the respective pedestal So1, So2. This allows for a compact design of the hood-type annealing furnace 100 and reduces the effort with respect to crane operations.

The closed transport gas path 118 is functionally connected to the first tube bank heat exchanger 108 and to the second tube bank heat exchanger 110 in such a way that thermal energy can be transferred between the first annealing gas 112 and the second annealing gas 114 by means of the transport gas 116 as described in greater detail below. When the first pedestal So1 is in a cooling phase, for example, thermal energy of the still hot first annealing gas 112 can be transferred to the transport gas 116 by means of a heat exchange in the first tube bank heat exchanger 108. The thusly heated transport gas 116 can be thermally coupled with the second annealing gas 114 by means of the second tube bank heat exchanger 110 and therefore serve for heating or pre-heating the second pedestal So2. Alternatively, thermal energy can be similarly transferred from the second annealing gas 114 to the first annealing gas 112.

Since a strict mechanical decoupling is realized between the transport gas path 118 and the transport gas 116 flowing therein on the one hand and the annealing gas 112 and the annealing gas 114 on the other hand, it is possible to keep the transport gas 116 in the transport gas path 118 under high pressure, for example 10 bar. Due to this high pressure, a large amount of thermal energy can be very efficiently exchanged between the first annealing gas 112 and the second annealing gas 114. Due to this decoupling of the annealing gas path and the transport gas path, it is furthermore possible to choose a different type of gas for the transport gas 116 than for the annealing gas 112, 114 such that both gas types can be optimized for the respective function independently of one another. Sooting or other dirt accumulations are also prevented in the interior of the first furnace chamber 104 and the second furnace chamber 106 because no exchange between annealing gas 112, 114 situated therein and transport gas 116 takes place.

An electric supply unit 124 is furthermore provided as part of the transport gas path 118. The electric supply unit 124 comprises a transformer 174 for two pedestals that is functionally coupled to an electric supply unit 176 for making available a high voltage. Depending on the switching state of a switch 178 (on the secondary side), an electric current is directly transmitted to the tube banks 108 or 110 via respective terminals 180 and 182 and via connecting tubes 126 of the transport gas path 118. However, it would also be possible to provide one transformer per pedestal in order to switch over at only about 1/10 of the amperage on the primary side. The electric supply unit 124 can also be completely deactivated. The electric current is routed from the low-resistance tube wall 126 to the tube bank heat exchanger 108 with a significantly higher resistance, at which the electric current is converted into heat generated due to ohmic losses. Consequently, the tube wall 126 serves as a current conductor while the actual heating takes place further on top of the tube bank. Thermal energy consequently is transferred to the first tube bank heat exchanger 108 and from there to the first annealing gas 112 and from the second tube bank heat exchanger 110 to the second annealing gas 114. The electric supply unit 124 makes it possible to heat the tube bank heat exchangers 108, 110. A first electric insulating device 184 in the region of the first pedestal Sol and a second electric insulating device 186 in the region of the second pedestal Sot ensure that the tube wall respectively is electrically decoupled above and underneath these insulating elements 184, 186.

In addition, a transport gas fan 140 is provided and designed for conveying the transport gas 116 through the transport gas path 118. A hot pressure fan may be used as transport gas fan 140. The transport gas path 118 furthermore contains a connectable cooler 142 for cooling the transport gas 116 in the transport gas path 118 with the aid of a gas-water heat exchanger (an electric cooling unit may be alternatively used at this location). One-way valves 144 are arranged at different locations of the transport gas path 118 and can be actuated, for example, electrically or pneumatically in order to open or close a certain gas routing path. Furthermore, multiple-way valves 146 are arranged at other locations of the transport gas path 118 and can be electrically or pneumatically actuated between several positions that correspond to several potential gas routing paths. The actuation of the valves 144, 146, as well as the connecting or disconnecting of the transport gas fan 140, the heating unit 124 or the cooling unit 142, may likewise be realized by means of electrical signals. The system may either be controlled manually by an operator or by a control unit such as, for example, a microprocessor that is not illustrated in FIG. 1 and that is capable of realizing an automated operating cycle of the hood-type annealing furnace 100.

According to FIG. 1, a pressure vessel 148 may also selectively enclose the transport gas fan 140. The pressure vessel 148 advantageously serves as pressure protection if the transport gas path 118 can be operated with a pressure, for example, of 10 bar. Other components of the transport gas path 118 may be realized in a pressure-resistant fashion or likewise be arranged in the interior of a pressure vessel.

FIG. 1 furthermore shows a control unit 166 that is designed for controlling and actuating the individual components of the furnace 100 as schematically indicated with arrows in FIG. 1.

The following portion of the description refers to FIGS. 2 to 5 that show different operating state of the hood-type annealing furnace 100, wherein these different operating states can be adjusted by controlling the position of the fluidic valves 144, 146 and of the electric switch 178 accordingly (by means of the control unit 166).

In a first operating state I illustrated in FIG. 2, the transport gas fan 140 is thermally coupled with the second annealing gas 114 such that the transport gas 116 absorbs heat from the second annealing gas 114 and transfers heat to the first annealing gas 112. In operating state I, the first furnace chamber 104 therefore is pre-heated and the second furnace chamber 106 is pre-cooled due to the fact that the transport gas 116 transfers thermal energy from the first annealing gas 112 to the second annealing gas 114. In this way, the batch (annealing material) of the pedestal So1 is heated and the batch (annealing material) of the second pedestal So2 is cooled.

FIG. 3 shows a second operating state II of the hood-type annealing furnace 100 that follows the first operating state I. In the second operating state II, the tube bank 108 electrically heats the first furnace chamber 104 with the electric supply unit 124 by closing a corresponding electrical path. The transport gas fan 140 conveys the transport gas 116 to the now connected cooler 142 along a separate fluidic path in order to cool the second annealing gas 114. The now cooled transport gas 116 is thermally coupled with the second annealing gas 114 in order to cool the second furnace chamber 106. According to FIG. 3, the batch (annealing material) of the first pedestal So1 therefore is further heated up whereas the batch (annealing material) of the second pedestal So2 is further cooled down.

After the second operating state II, the now heat-treated and meanwhile cooled batch of annealing material 102 is removed from the second pedestal So2. For this purpose, a crane can remove the second protective hood 122, subsequently remove the annealing material 102 arranged in the second pedestal So2 and ultimately place a new batch of annealing material 102 into the second pedestal So2.

A third operating state III illustrated in FIG. 4 is subsequently activated. In this third operating state III, the transport fluid fan 140 thermally couples the transport fluid 116 with the first annealing gas 112 such that the transport gas 116 absorbs heat from the first annealing gas 112 and transfers heat to the second annealing gas 114. In this way, the second furnace chamber 104 is pre-heated and the first furnace chamber 106 is pre-cooled.

A fourth operating state IV illustrated in FIG. 5 is activated after this third operating state III. In the fourth operating state IV, the tube bank 110 further heats only the second furnace chamber 106 in an electric manner by means of the electric supply unit 124. The transport fluid fan 140 conveys the transport gas 116 to be cooled to the now connected cooler 142 along a separate fluidic path. The cooled transport gas 116 is thermally coupled with the first annealing gas 112 in order to further cool down the first furnace chamber 104. Consequently, the batch (annealing material) of the first pedestal So1 is now further cooled and the batch (annealing material) of the second pedestal So2 is further heated up in an electric manner.

After the fourth operating state IV, the now heat-treated and meanwhile cooled batch of annealing material 102 is removed from the first pedestal Sol. For this purpose, a crane can remove the first protective hood 120, subsequently remove the annealing material 102 arranged in the first pedestal So1 and ultimately place a new batch of annealing material 102 into the first pedestal So1.

The cycle of operating states I to IV can now begin anew, i.e. the hood-type annealing furnace 100 is in the next operating state once again operated in accordance with FIG. 2.

Figure 6:
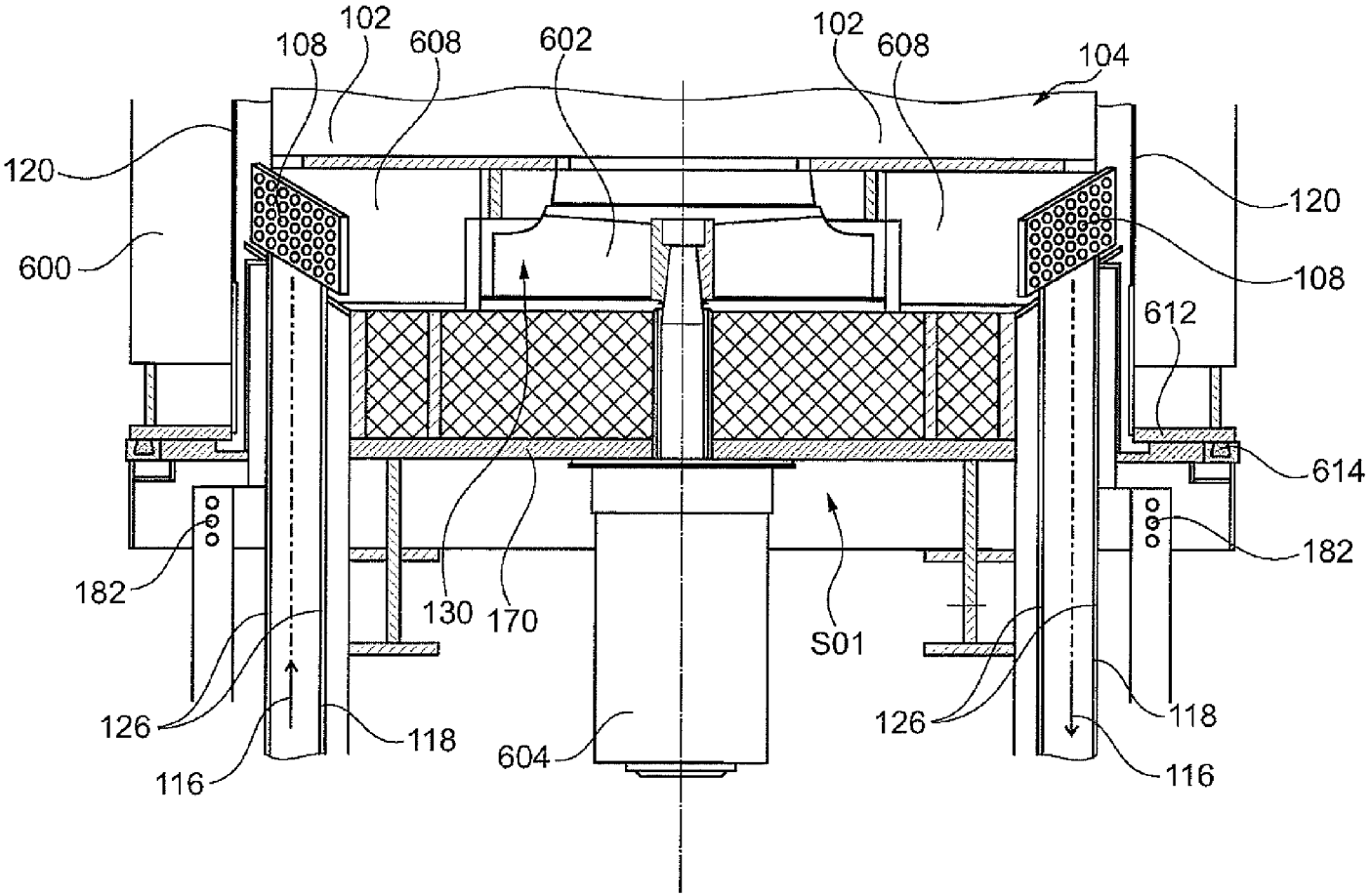
FIG. 6 shows a detail of an inventive annealing pedestal of the hood-type annealing furnace according to FIG. 1.

FIG. 6 shows an enlarged representation of part of the first pedestal Sol of the hood-type annealing furnace, in which the arrangement of the tube bank heat exchanger 108 including input and output lines in the full flow is illustrated in greater detail. The thermal insulation of the protective hood 120 is identified by the reference numeral 600.

The first annealing gas fan 130 is a radial fan, the impeller 602 of which is driven by a motor 604. The impeller 602 is enclosed by a guide apparatus 608 with guide vanes. The annealing material 102 resting on the annealing pedestal, which is only indicated schematically, is covered by the protective hood 120 that is supported by an annular flange 612, which ensures that the protective hood 120 is sealed in a gas-tight fashion with the aid of a peripheral seal 614.

Figure 7:
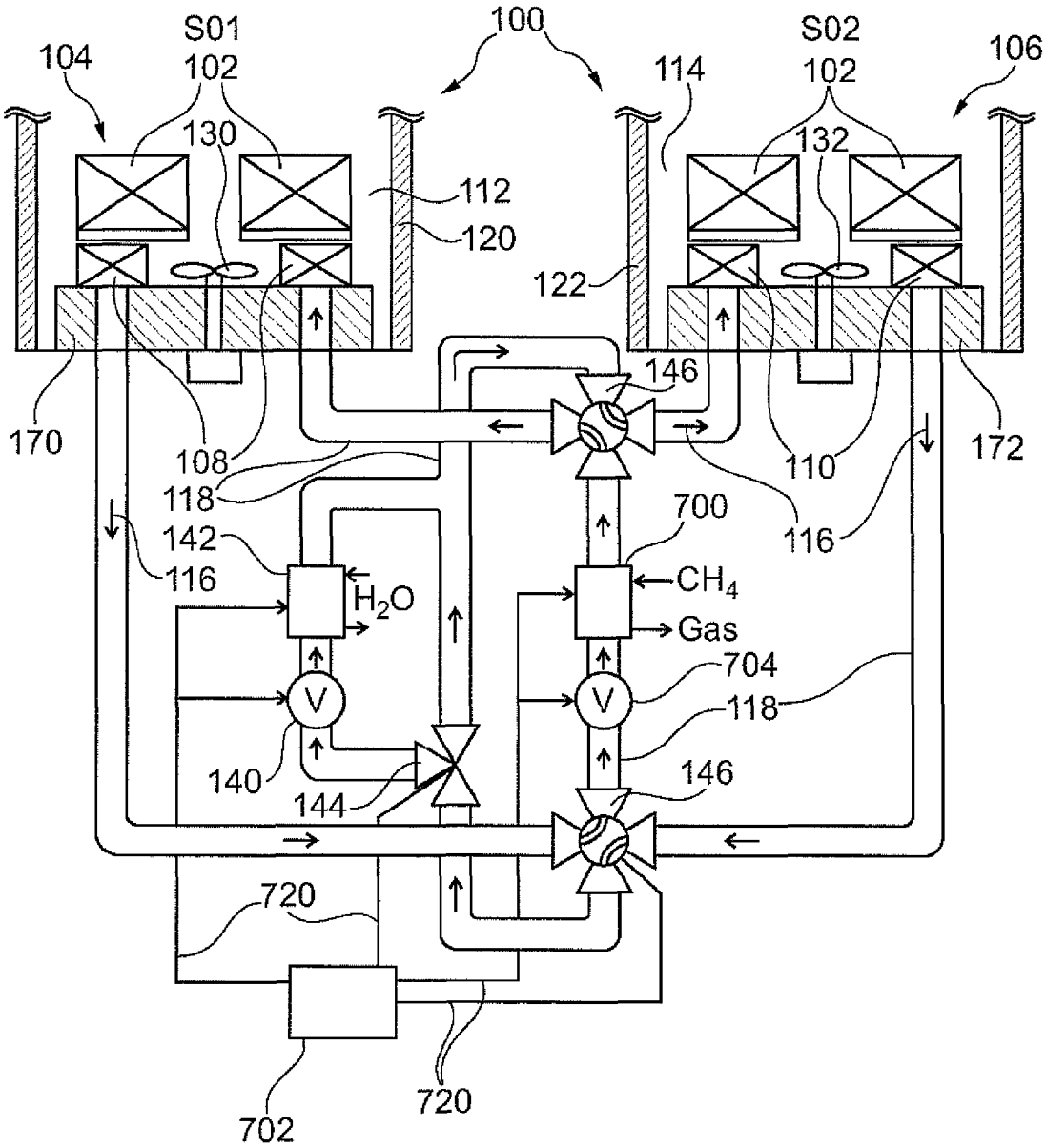
FIG. 7 shows a hood-type annealing furnace for heat-treating annealing material with a plurality of pedestals according to another exemplary embodiment, wherein an annealing gas can be heated or cooled in the furnace by means of a heat exchanger. The heating of the heat exchanger is initially accomplished by means of a transport gas from another heat exchanger (a cooling pedestal) and subsequently by means of an external gas heating unit. The cooling of the heat exchanger is initially accomplished by means of a transport gas from another heat exchanger (a heating pedestal) and subsequently by means of a connectable cooling device.

FIG. 7 shows a hood-type annealing furnace 100 according to another exemplary embodiment.

In the hood-type annealing furnace 100 according to FIG. 7, a gas heating unit 700 arranged externally of the furnace is provided instead of the electrically heated furnace-internal heat exchanger banks 108/110 with an electric supply unit 124. Alternatively, an electric heating unit may also be used as furnace-external heating unit. The gas heating unit 700 is assigned a separate heating fan 704 that conveys transport gas 116 heated by the gas heating unit 700 through a tube system. According to FIG. 7, transport gas 116 heated by the gas heating unit 700 is conveyed through the tube bank heat exchangers 108, 110.

Furthermore, a control unit 702 is provided and designed for actuating the various valves 144, 146, as well as activating or deactivating the cooler 142, the gas heating unit 700 and the fans 140, 704, via various control lines 720. The fan 140 may be realized in the form of a cold pressure fan whereas the fan 704 is a hot pressure fan.

The gas heating unit 700 acts as a heater and is realized in the form of a gas-heated heat exchanger for transferring thermal energy to the transport gas 116.

The region underneath the furnace bases 170, 172 in FIG. 7 may be entirely or partially accommodated in the interior of a high-pressure vessel in order to provide protection against the high pressure in the transport gas system 118.

FIGS. 8 to 11 show four operating states of the hood-type annealing furnace 100 according to FIG. 7 that functionally correspond to the operating states I to IV described with reference to FIGS. 2 to 5.

Figure 8:
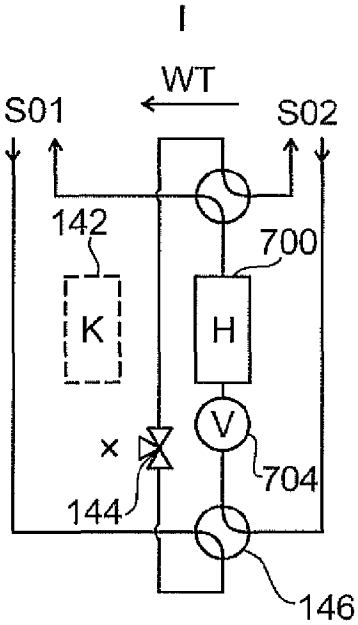
FIGS. 8 to 11 show schematic representations of different operating states during a cyclic process for operating the hood-type annealing furnace according to FIG. 7.

According to the operating state I in FIG. 8, the cooler 142 is separated from the rest of the system. The gas heating unit 700 is deactivated. Heat is transferred from the second annealing gas 114 of the second pedestal So2 to the first annealing gas 112 in the first pedestal So1.

Figure 9:
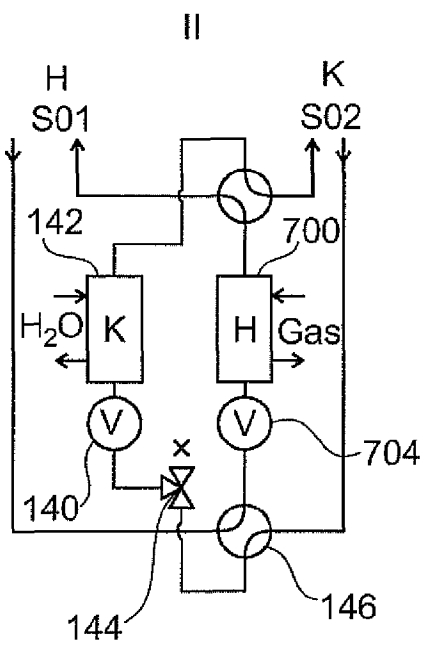

According to the operating state II in FIG. 9, the first pedestal So1 is additionally heated by the now activated gas heating unit 700 while the cooler 142 is now activated in another separate gas path and additionally cools the second annealing gas 114 in the second pedestal So2 in an active fashion.

At the end of operating state II, the annealing material 102 can be removed from the second pedestal So2 and replaced with a new batch of annealing material 102 to be heat-treated.

Figure 10:
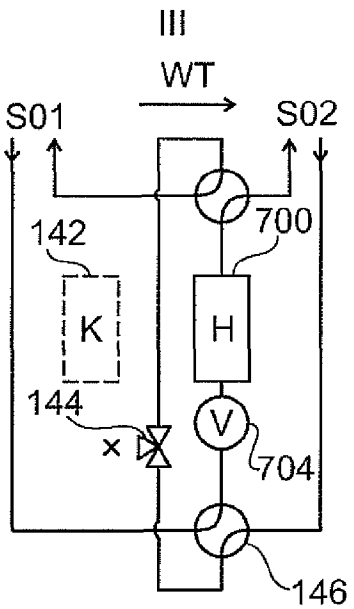

FIG. 10 shows a third operating state III, in which thermal energy is transferred from the first annealing gas 112 in the first pedestal So1 to the second annealing gas 114 in the second pedestal So2. The cooler 142 and the gas heating unit 700 are deactivated in this state.

Figure 11:
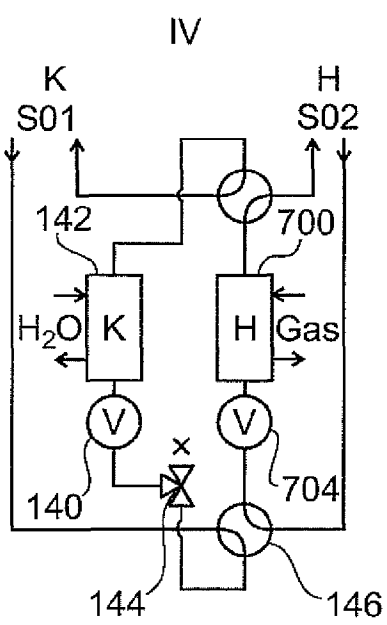

The operating state III is then replaced by the operating state IV illustrated in FIG. 11. According to this operating state, the cooler 142 is activated and additionally cools the first pedestal So1 in an active manner. In a separate fluid path, the gas heating unit 700 additionally heats the second pedestal So2 in an active manner.

After carrying out the procedure according to the fourth operating state IV, the annealing material 102 can be removed from the first pedestal So1 and replaced with a new batch of annealing material 102.

A first diagram 1200 and a second diagram 1250 are described below with reference to FIG. 12. The first diagram 1200 has an abscissa 1202, wherein the time, in which the operating states I to IV are activated, is plotted along this abscissa. The temperature of the respective annealing gas or the annealing material during the activation of the operating states I to IV is plotted along an ordinate 1204. The abscissa 1202 and the ordinate 1204 are also chosen accordingly in the second diagram 1250.

The first diagram 1200 relates to a temperature profile of the first annealing gas 112 or the annealing material of the first pedestal So1 while the individual operating states I to IV are activated whereas the second diagram 1250 relates to a temperature profile of the second annealing gas 114 or the annealing material of the second pedestal So2 during the operating states I to IV according to FIG. 1 or FIG. 7. In the first operating state I, thermal energy is transferred from the second annealing gas 114 in the pedestal So2 to the first annealing gas 112 in the pedestal So1 (first heat exchange WT1 with energy transfer E). In the second operating state II, the first pedestal So1 with annealing material is further heated (H) in an active manner whereas the second pedestal So2 with annealing material is further cooled down (K) in an active manner. In the ensuing third operating state III, thermal energy is transferred from the first annealing gas 112 or the annealing material in the first pedestal So1 to the second annealing gas 114 or the annealing material in the second pedestal So2 (second heat exchange WT2 with energy transfer E). In the fourth operating state IV, the first pedestal So1 with annealing material is further cooled down in an active manner whereas the second pedestal So2 with annealing material is further heated in an active manner.

Figure 12:
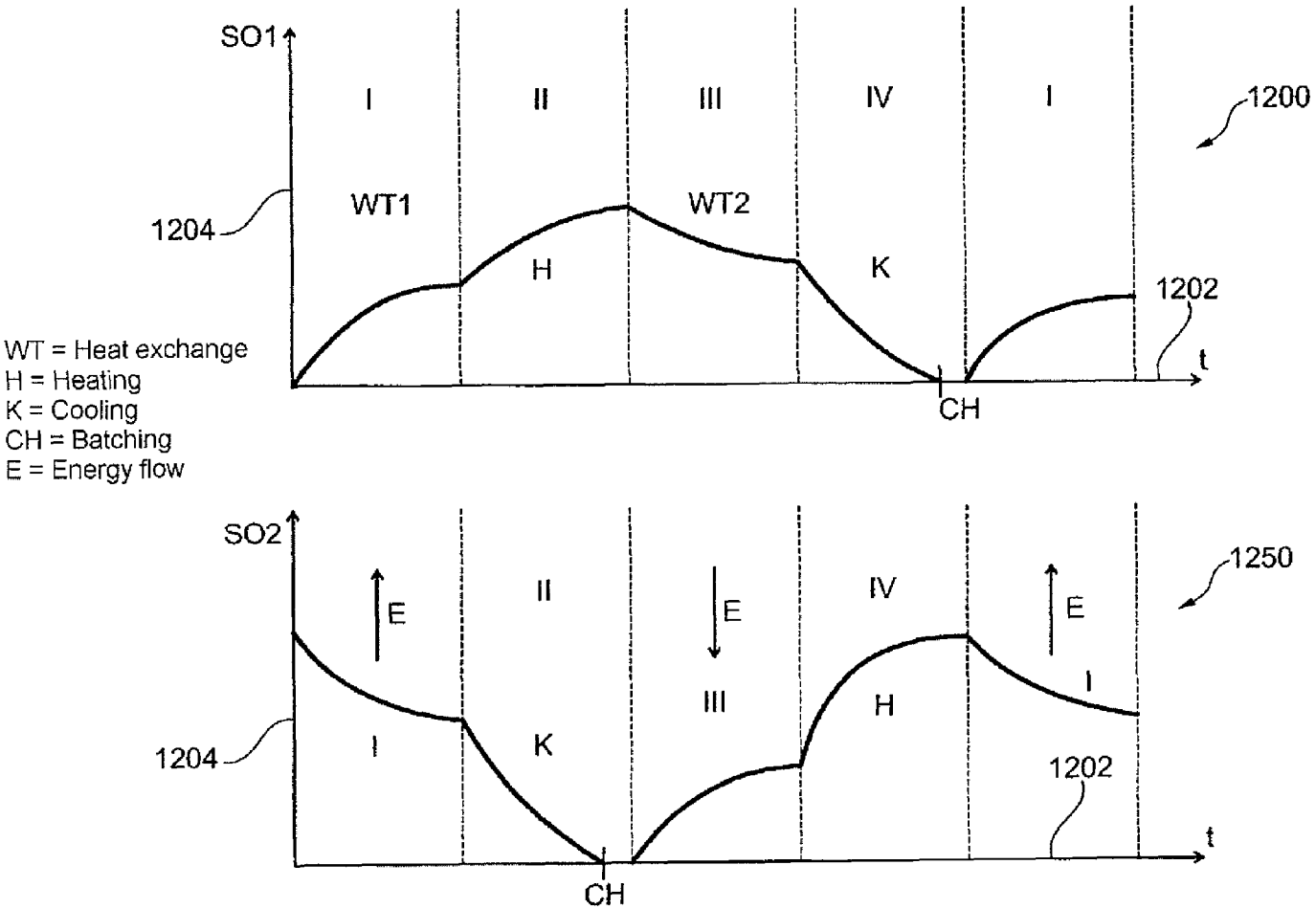
FIG. 12 shows temperature-time curves of the hood-type annealing furnace illustrated in FIG. 1 and FIG. 7, in which the respective temperature profiles of the individual pedestals are illustrated for the different operating states.

Consequently, FIG. 12 shows the temperature profile in a two-pedestal mode according to FIG. 1 or according to FIG. 7. The energy consumption can be reduced to approximately 60% with such a one-stage heat exchange (i.e., one-stage pre-heating of a pedestal with annealing material by transferring annealing gas heat from the respectively other pedestal prior to the active additional heating by means of a heating unit). Such an exemplary embodiment is simple and reduces the energy consumption by 40% due to the reuse of waste heat of a respective pedestal with annealing material to be cooled.

Figure 13:
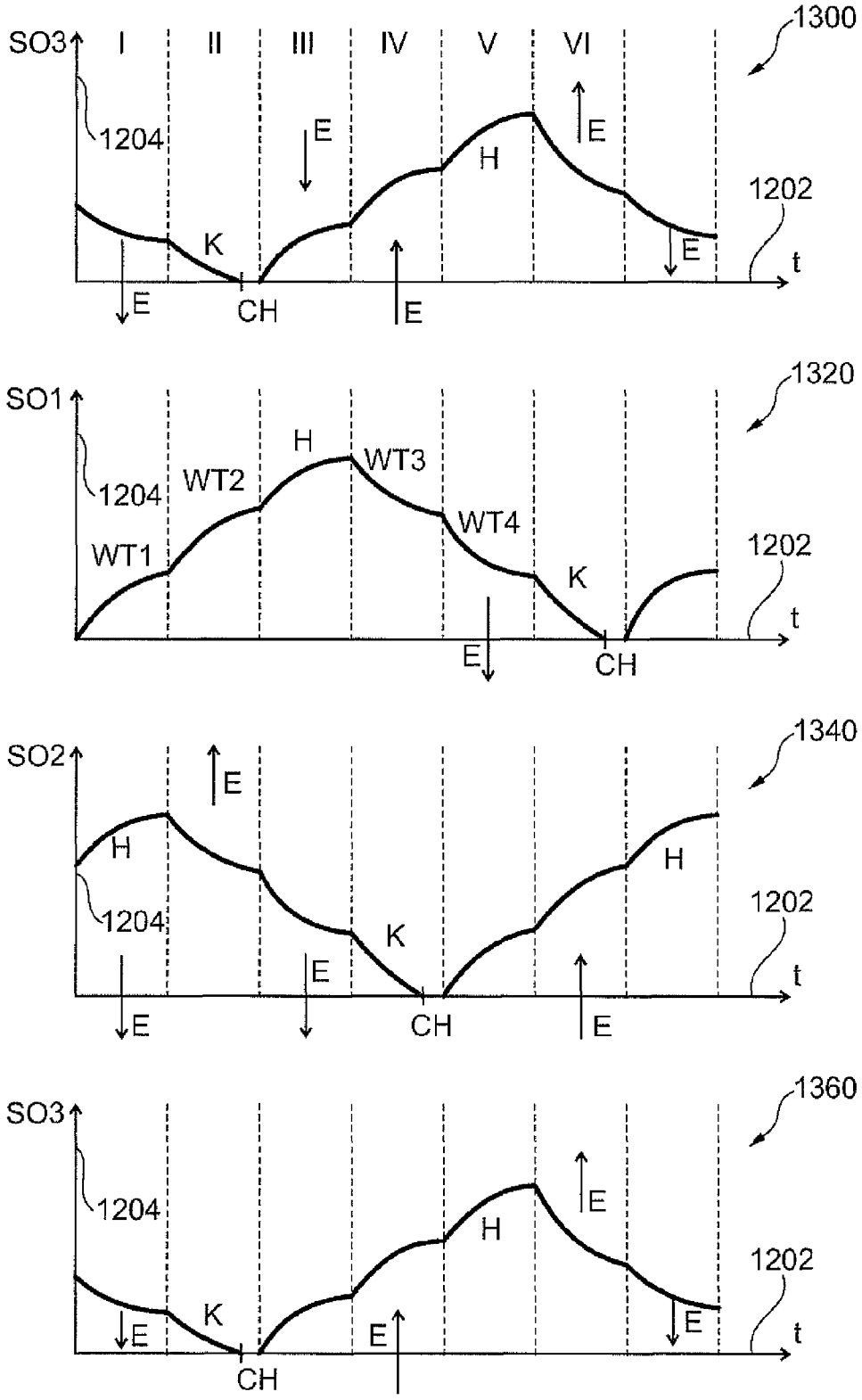
FIG. 13 shows temperature-time histories of a two-stage operation of an inventive hood-type annealing furnace with a two-stage pre-heating phase, a heating phase, a two-stage pre-cooling phase and a final cooling phase, wherein three pedestals can be thermally coupled by means of a transport gas path.

FIG. 13 shows a first diagram 1300, a second diagram 1320, a third diagram 1340 and a fourth diagram 1360 of a two-stage heat exchange system, in which three pedestals are provided in a hood-type annealing furnace rather than the two pedestals in FIG. 1 and FIG. 7. In such a two-stage heat exchange, one pedestal with annealing material is pre-heated in two stages by transferring annealing gas heat from the respectively other two pedestals with annealing material (successively, i.e. in two stages) prior to the active further heating by means of a heating unit.

In this heat exchange system, one can distinguish between six different operating states:

In a first operating state I, a third pedestal So3 is pre-cooled and transfers thermal energy from the third annealing gas to the first annealing gas by means of the transport gas in order to pre-heat a pedestal So1. A second pedestal So2 is separated from the first and the third pedestal in this operating state and is simultaneously heated to a final temperature by means of a heating device.

In an ensuing second operating state II, the pedestal So3 is actively cooled by means of a cooler whereas the pedestal So2 that should now be pre-cooled transfers thermal energy from its second annealing gas to the first annealing gas of the first pedestal So1 In this way, the first pedestal So1 is additionally pre-heated.

In a third operating state III, the third pedestal So3 is again heated by transferring thermal energy from the second pedestal So2 to the third pedestal So3 by means of the transport gas. The third pedestal So3 is pre-heated in this way. Since the second pedestal So2 transfers thermal energy from its second annealing gas to the third annealing gas of the third pedestal So3, its energy drops in the third operating state III. The first pedestal So1 is now isolated from the other pedestals So2 and So3 and heated to a final temperature by means of a heating device.

In an ensuing fourth operating state IV, the first pedestal So1 is pre-cooled by transferring thermal energy from the first annealing gas to the third annealing gas of the pedestal So3. In this way, the third pedestal So3 is additionally pre-heated. The second pedestal So2 is in the fourth operating state separated from the other two pedestals So1, So3 and is further cooled in an active manner with a cooler in order to reach its lower final temperature at the end of the fourth operating mode IV.

In an ensuing fifth operating state V, the third pedestal So3 is separated from the other pedestals So1, So2 and actively connected to the heating unit in order to be brought to the final temperature. The pedestal So1 to be further cooled transfers thermal energy from its annealing gas to the second annealing gas of the second pedestal So2. The latter is therefore subjected to a first pre-heating phase.

In an ensuing sixth operating mode VI, thermal energy is transferred from the third pedestal So3 that should now be pre-cooled to the second pedestal So2. In this way, the second pedestal So2 is subjected to a second pre-heating phase and the third pedestal So3 is pre-cooled. The first pedestal Sol is in this operating state isolated from the pedestals So2, So3 and cooled to a final temperature by means of a cooler. After the end of operating state IV, the cycle begins once again with the first operating state I.

FIG. 13 therefore relates to a two-state heat exchange in a three-pedestal mode. The energy consumption can be reduced to 40%. A corresponding inventive furnace has still a simple design and makes it possible to achieve an energy gain of approximately 60%.

Figure 14:
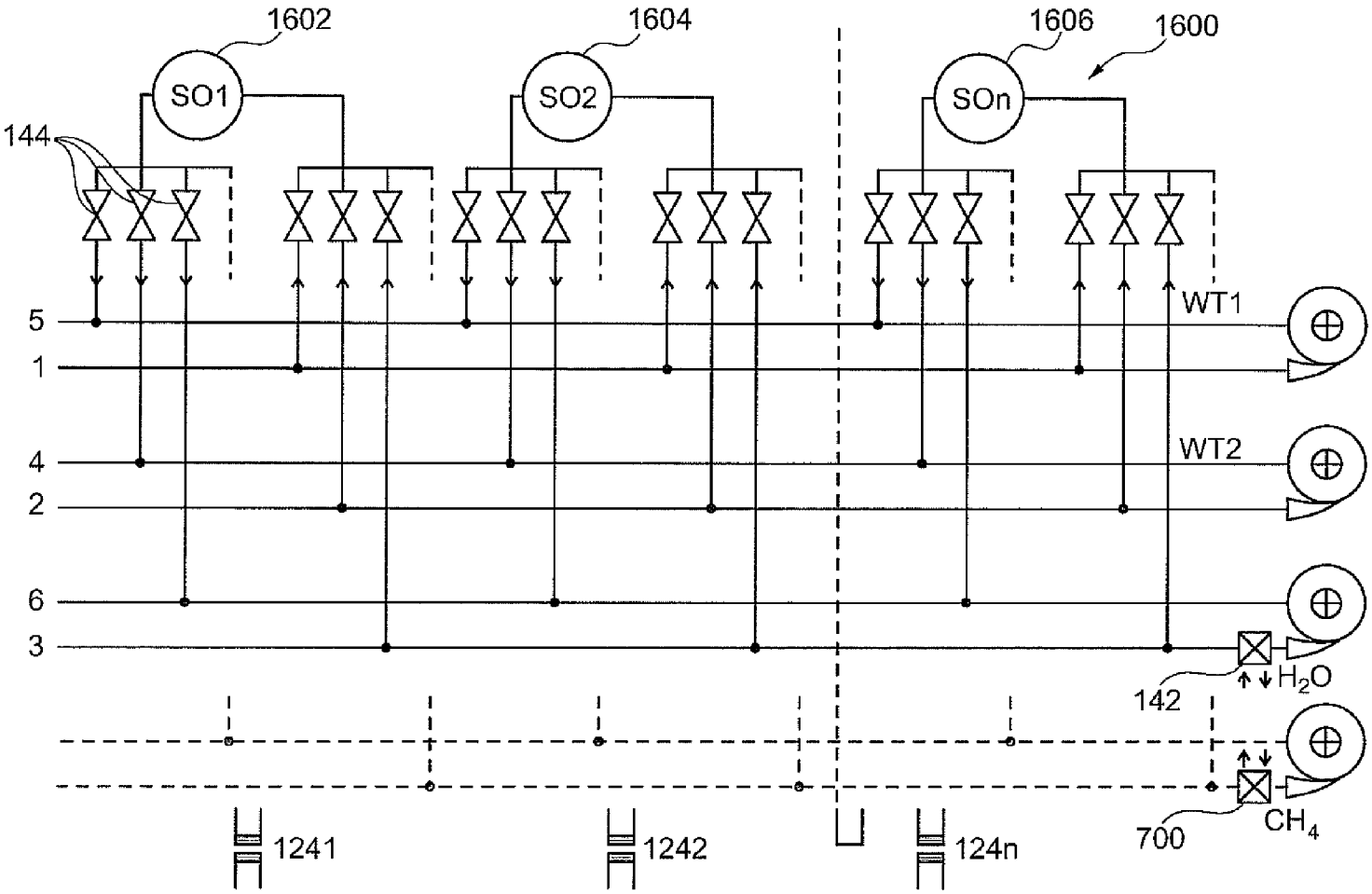
FIG. 14 shows a schematic representation of a multi-pedestal furnace with a two-stage heat exchange according to an exemplary embodiment.

FIG. 14 shows a schematic representation of a furnace 1600 with n pedestals according to another exemplary embodiment. A first pedestal Sol 1602, a second pedestal So2 1604 and an n-th pedestal SoN 1606 are schematically illustrated in this figure. The architecture according to FIG. 16 can be applied to any number of pedestals. FIG. 14 also shows a plurality of one-way valves 144. Furthermore, a cooling unit 142 and an external heating unit 700 (in this case a gas heating unit that could alternatively consist of an electric resistance heater) are also illustrated in this figure. If the tube bank heat exchanger is used directly, i.e. internally, as an electric resistance heater, one electric supply unit (1241, 1242, . . . , 124N) is provided per pedestal. In a two-stage heat exchange, one fan unit is respectively provided for WT1 and WT2.

Figure 15:
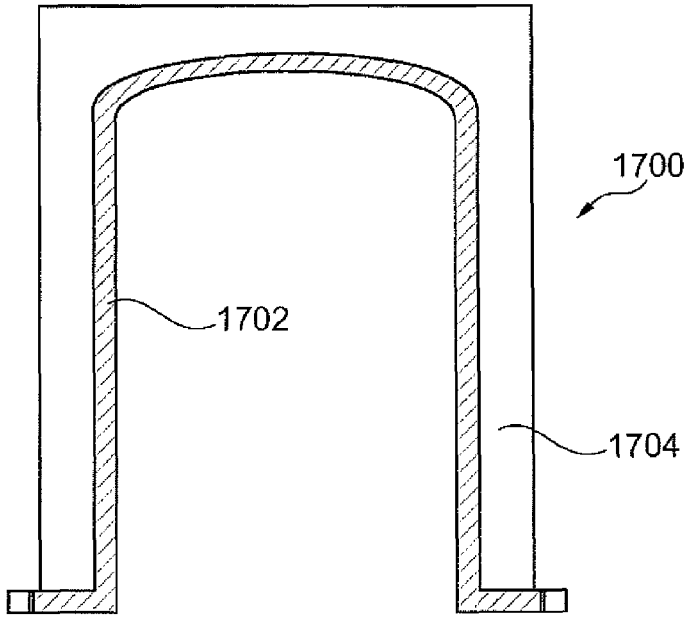
FIG. 15 shows a thermally insulated protective hood that can be used in conjunction with a furnace according to an exemplary embodiment.

FIG. 15 shows a bell-shaped protective hood 1700, for example, of the type identified by the reference numerals 120, 122 in FIG. 1. The protective hood 1700 has a continuous internal housing of a heat-resistant material 1702 and an outer thermal insulation 1704 in order to protect the respective pedestal from heat loss through the protective hood 1700. The configuration shown can be advantageously utilized in a hood-type annealing furnace. In a batch furnace, in contrast, it may be advantageous to combine an inner wall of a thermally insulating material with a radiant outer wall, i.e. to effectively interchange the reference numerals 1702 and 1704.

Figure 16:
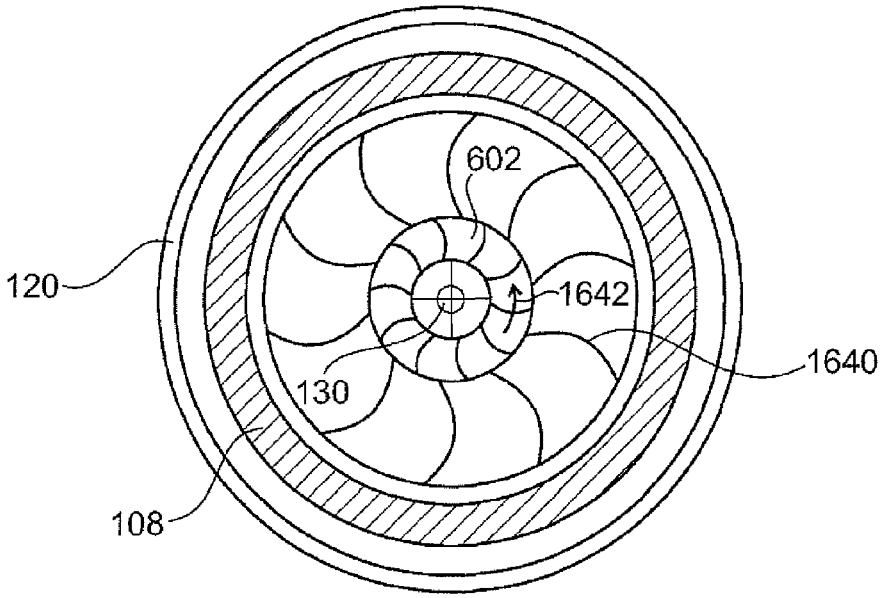
FIG. 16 shows a top view of a hood-type annealing furnace of the type illustrated in FIG. 6, in which a furnace atmosphere is essentially conveyed to a tube bank heat exchanger in the form of a full flow independently from the operating state by a circulating unit in order to respectively ensure a good thermal coupling between the circulating unit and the tube bank heat exchanger for heating, cooling and heat exchanging procedures.

FIG. 16 shows a top view of a hood-type annealing furnace of the type illustrated in FIG. 6, in which an annealing gas fan 130 causes heated annealing gas to flow to a tube bank heat exchanger 108 in a directed fashion (and preferably to essentially the full extent). Consequently, a good thermal coupling between the annealing gas fan 130 and the tube bank heat exchanger 108 can be ensured for all operating states of the hood-type annealing furnace, i.e. for heating a pedestal, for cooling a pedestal and for exchanging heat between pedestals.

In more precise terms, an impeller 602 of the annealing gas fan 130 is driven in a rotatable manner; see the reference numeral 1642. In this way, the annealing gas is circulated by the annealing gas fan 130. The annealing gas therefore moves outwardly, namely in a directed manner under the influence of the resting vanes 1640 of a guide apparatus. In this way, the annealing gas is purposefully caused to thermally interact with the tube bank heat exchanger 108, as well as with the batch (annealing material). The tube bank heat exchanger 108 therefore is situated in a full flow.

Figure 17:
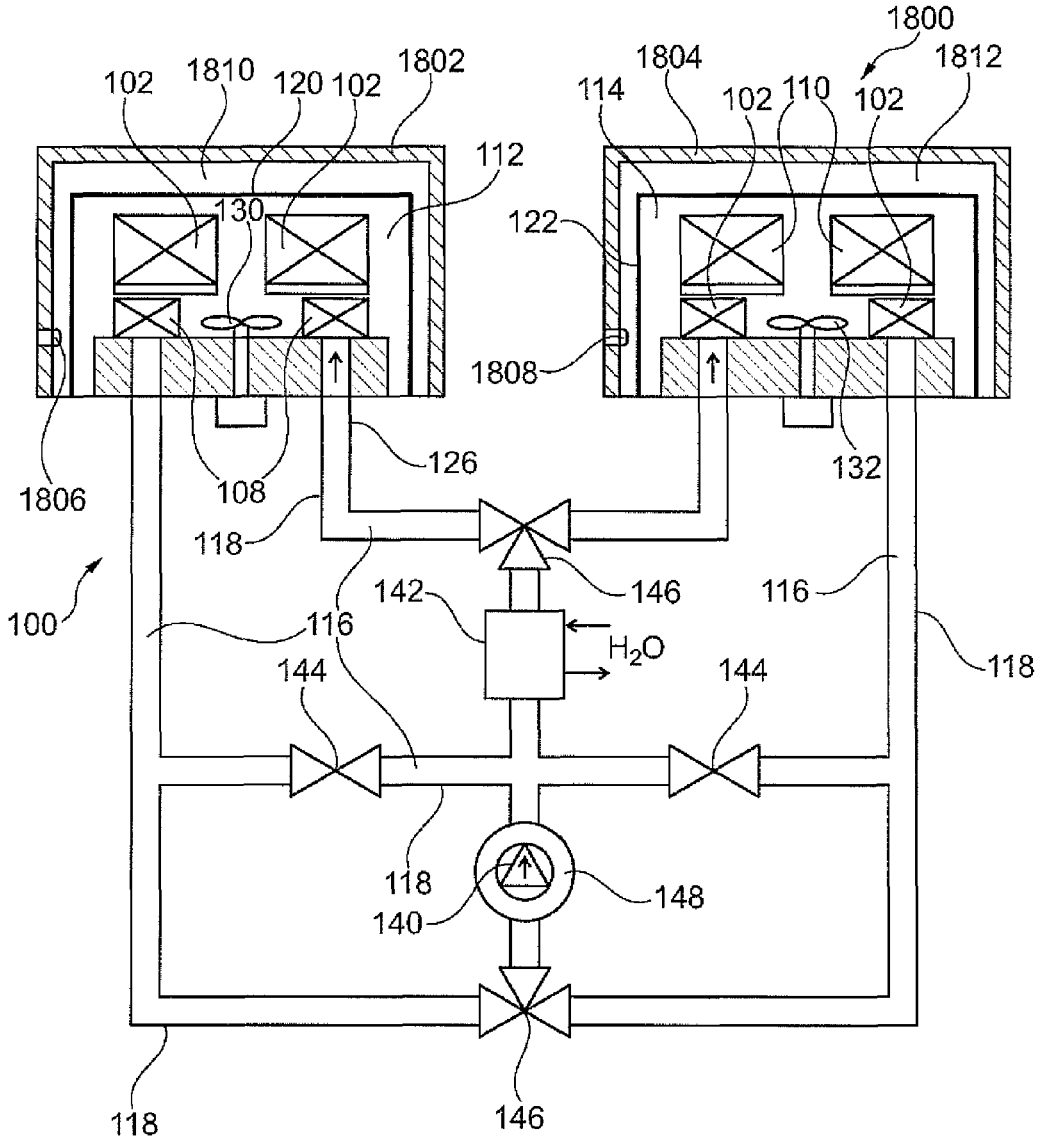
FIG. 17 shows a furnace according to another exemplary embodiment, in which only the heat exchange from cooling to heating annealing material is utilized and, therefore, in addition to the protective hoods respectively one heating hood is provided per each pedestal. The final cooling is realized with a gas/water cooler analogous to FIG. 1.

FIG. 17 shows a furnace 1800 according to yet another exemplary embodiment. The furnace 1800 is designed similar to FIG. 1, but comprises a removable first heating hood 1802 that is provided in addition to and encloses the first protective hood 120. The second protective hood 122 of the second pedestal is accordingly covered by a second heating hood 1804. The first heating burners 1806 are arranged in an intermediate space 1810 between the first heating hood 120 and the first protective hood 1802 in order to heat the protective gas within the protective hood. In the second furnace chamber 106, the second heating burners 1808 are accordingly arranged for heating the intermediate space 1812 between the second heating hood 122 and the second protective hood 1804. It would also be conceivable to provide electric resistance heating elements instead of the heating burners 1806, 1808. The electric supply unit 124 according to FIG. 1 is eliminated in FIG. 17. However, the connectable gas-water heat exchanger 142 is still provided.

According to the exemplary embodiment of FIG. 17, the main heating of the first annealing gas 112 and of the second annealing gas 114, respectively, is realized by means of the thermal interaction between the heated gas in the intermediate space 1810 and the first annealing gas 112 respectively the heated gas in the intermediate space 1812 and the second annealing gas 114 (or an electric resistance heater). The transport fluid path 118 is in this exemplary embodiment used for the thermal balance between the first annealing gas 112 and the second annealing gas 114 in order to carry out a pre-cooling or a pre-heating process and to thusly save energy. Furthermore, a final cooling process can be realized with a cooling unit 142 assigned to the transport gas path 118.

It should furthermore be noted that a cooling hood can also be attached in the exemplary embodiment according to FIG. 15.

As a supplement, it should be noted that "comprising" does not exclude any other elements or steps and that "a" or "an" does not exclude a plurality. It should furthermore be noted that features or steps that were described with reference to one of the above exemplary embodiments can also be used in combination with other features or steps of other above-described exemplary embodiments. Reference numerals in the claims should not be interpreted in a restrictive sense.

The invention claimed is:

1. A furnace for heat treating an annealing material, wherein the furnace comprises:

a sealable first furnace chamber that is designed for accommodating and heat treating annealing material by means of a thermal interaction of the annealing material with a heatable or coolable first annealing gas in the first furnace chamber;

a first heat exchanger that is arranged in the first furnace chamber, which first heat exchanger is designed for exchanging heat between the first annealing gas and a transport fluid, wherein the first heat exchanger is arranged within a housing section within a full flow of a fan, of the first furnace chamber, which housing section confines the first annealing gas in the interior of the first furnace chamber, and which housing section is in direct contact with the first annealing gas;

a sealable second furnace chamber that is designed for accommodating and heat treating annealing material by means of a thermal interaction of the annealing material with a heatable or coolable second annealing gas in the second furnace chamber;

a second heat exchanger that is arranged in the second furnace chamber, which second heat exchanger is designed for exchanging heat between the second annealing gas and the transport fluid, wherein the second heat exchanger is arranged within a housing section within a full flow of a fan, of the second furnace chamber, wherein the housing section confines the second annealing gas in the interior of the second furnace chamber; and a closed transport fluid path that is functionally connected to the first heat exchanger and the second heat exchanger in such a way that thermal energy can be transferred between the first annealing gas and the second annealing gas in a contactless manner by means of the transport fluid.

2. The furnace as set forth in claim 1, wherein the furnace is of a batch-operable furnace in the form of a hood type annealing furnace or a batch type furnace.

3. The furnace as set forth in claim 1, wherein the first furnace chamber can be sealed with a removable first protective hood representing the housing section of the first furnace chamber and the second furnace chamber can be sealed with a removable second protective hood representing the housing section of the second furnace chamber, and wherein the first protective hood is the outermost hood, and the only hood, of the first furnace chamber and the second protective hood is the outermost hood, and the only hood, of the second furnace chamber.

4. The furnace as set forth in claim 1, wherein the housing section of the second furnace chamber is in direct contact with the second annealing gas.

5. The furnace as set forth in claim 3, wherein the first protective hood and the second protective hood respectively comprise a heat-resistant inner housing of a metal, and an insulating cover of a thermally insulating material.

6. The furnace as set forth in claim 1, wherein an external heating unit for directly heating the transport fluid being conveyed to the first heat exchanger or to the second heat exchanger is designed in such a manner that the first furnace chamber can be heated by transferring thermal heat to the first annealing gas and/or the second furnace chamber can be heated by transferring thermal heat to the second annealing gas, wherein the external heating unit can be operated with gas, oil or pellets or comprises an electric resistance heater.

7. The furnace as set forth in claim 6, wherein an electric supply unit of the heating unit supplies electric energy to the first heat exchanger or to the second heat exchanger in the form of an electric resistance heater and therefore internally and directly.

8. The furnace as set forth in claim 1, wherein the first furnace chamber can be sealed with a removable first heating hood that can be heated with gas or electrically and encloses a first protective hood, and wherein the second furnace chamber can be sealed with a removable second heating hood that can be heated with gas or electrically and encloses a second protective hood.

9. The furnace as set forth in claim 1, wherein the first heat exchanger and/or the second heat exchanger is a tube bank heat exchanger made from tubes that are bent into a bank, wherein the tube interior forms a part of a transport fluid path, through which a transport fluid can flow, and the tube exterior is brought in direct contact with the respective annealing gas.

10. The furnace as set forth in claim 1, wherein the first furnace chamber comprises a first annealing gas drive and the second furnace chamber comprises a second annealing gas drive, and wherein the respective annealing gas drives are designed for directing the respective annealing gas at the respective heat exchanger and at the respective annealing material.

11. The furnace as set forth in claim 1, wherein the transport fluid is a transport gas of hydrogen, helium or another gas with a good thermal conductivity, and wherein the transport fluid in the transport fluid path is subjected to a pressure between about 2 bar and about 20 bar or more, and wherein the transport fluid in the transport fluid path has a temperature in the range between about 400° C. and about 1100° C.

12. The furnace as set forth in claim 1, furthermore comprising:

a sealable third furnace chamber that is designed for accommodating and heat treating annealing material by means of a thermal interaction of the annealing material with a heatable third annealing gas in the third furnace chamber; and a third heat exchanger that is arranged in the third furnace chamber and designed for exchanging heat between the third annealing gas and the transport fluid, wherein the third heat exchanger is arranged within a housing section in a full flow of a fan, of the third furnace chamber, wherein the housing section confines the third annealing gas in the interior of the third furnace chamber; and wherein the closed transport fluid path is also functionally connected to the third heat exchanger in such a way that thermal energy can be transferred between the third annealing gas on the one hand and the first annealing gas and/or the second annealing gas on the other hand by means of the transport fluid.

13. The furnace as set forth in claim 1, further comprising a control unit that is designed for controlling the transport fluid path in such a manner that by exchanging heat between the transport fluid and the first annealing gas and the second annealing gas respectively one of the first furnace chamber and the second furnace chamber can be selectively operated in a pre-heating mode, in a heating mode or in a cooling mode.

14. The furnace as set forth in claim 1, wherein the transport fluid path comprises a transport fluid drive for conveying the transport fluid through the transport fluid path.

15. The furnace as set forth in claim 1, wherein the transport fluid path comprises a connectable cooler for cooling the transport fluid in the transport fluid path.

16. The furnace as set forth in claim 14, wherein the transport fluid path comprises a plurality of valves that can be actuated in such a way that the furnace can be selectively operated in one of the following operating modes:

a first operating mode, in which the transport fluid drive thermally couples the transport fluid with the second annealing gas such that the transport fluid absorbs heat from the second annealing gas and transfers heat to the first annealing gas in order to heat the first furnace chamber and to cool the second furnace chamber;

an ensuing second operating mode, in which a heating unit, internally or externally, continues to heat the first furnace chamber, and in which in a path being separated from the transport fluid drive conveys the transport fluid to the connected cooler for cooling and thermally couples the cooled transport fluid with the second annealing gas in order to additionally cool the second furnace chamber;

an ensuing third operating mode, in which the transport fluid drive thermally couples the transport fluid with the first annealing gas such that the transport fluid absorbs heat from the first annealing gas and transfers heat to the second annealing gas in order to heat the second furnace chamber and to cool the first furnace chamber; and an ensuing fourth operating mode, in which the heating unit heats the second furnace chamber, and in which in a path being separated from the transport fluid drive conveys the transport fluid to the connected cooler (142) for cooling and thermally couples the cooled transport fluid with the first annealing gas in order to cool the first furnace chamber.

17. The furnace as set forth in claim 1, further comprising a means for the pressure stabilization of the transport fluid path, being a pressure vessel that encloses at least part of the transport fluid path in a pressure-tight fashion.

18. The furnace as set forth in claim 1, wherein the first heat exchanger is arranged relative to a first annealing gas fan for conveying the first annealing gas and/or the second heat exchanger is arranged relative to a second annealing gas fan for conveying the second annealing gas in such a way that in each operating state of the furnace the first annealing gas conveyed by the first annealing gas fan flows against the first heat exchanger and/or that in each operating state of the furnace the second annealing gas conveyed by the second annealing gas fan flows against the second heat exchanger.

19. The furnace as set forth in claim 1, wherein the furnace is configured in such a way that the first annealing gas and the second annealing gas do not come in contact with the transport fluid.

20. A method for heat treating an annealing material in a furnace, wherein the method comprises:

accommodating and heat treating annealing material in a sealable first furnace chamber by means of a thermal interaction of the annealing material with a heatable or coolable first annealing gas in the first furnace chamber;

causing a heat exchange between the first annealing gas and a transport fluid by means of a first heat exchanger arranged in the first furnace chamber, wherein the first heat exchanger is arranged within a housing section in a full flow of a fan of the first furnace chamber, wherein the housing section confines the first annealing gas in the interior of the first furnace chamber, and wherein the housing section is in direct contact with the first annealing gas;

accommodating and heat treating annealing material in a sealable second furnace chamber by means of a thermal interaction of the annealing material with a heatable or coolable second annealing gas in the second furnace chamber;

causing a heat exchange between the second annealing gas and the transport fluid by means of a second heat exchanger arranged in the second furnace chamber, wherein the second heat exchanger is arranged within a housing section in a full flow of a fan of the second furnace chamber, and wherein the housing section confines the second annealing gas in the interior of the second furnace chamber; and controlling a closed transport fluid path that is functionally connected to the first heat exchanger and to the second heat exchanger in such a way that thermal energy is transferred between the first annealing gas and the second annealing gas by means of the transport fluid.

* * * * *